US009091064B1

(12) United States Patent
Dahl

(10) Patent No.: US 9,091,064 B1
(45) Date of Patent: Jul. 28, 2015

(54) REBAR ANCHORAGE DEVICE AND METHOD FOR CONNECTING SAME TO A REBAR

(71) Applicant: Christian L. Dahl, Newport Coast, CA (US)

(72) Inventor: Christian L. Dahl, Newport Coast, CA (US)

( * ) Notice: Subject to any disclaimer, the term of this patent is extended or adjusted under 35 U.S.C. 154(b) by 0 days.

(21) Appl. No.: 14/202,578

(22) Filed: Mar. 10, 2014

(51) Int. Cl.
*E04C 5/12* (2006.01)
*E04G 17/07* (2006.01)

(52) U.S. Cl.
CPC . *E04C 5/122* (2013.01); *E04C 5/12* (2013.01); *E04G 17/0721* (2013.01)

(58) Field of Classification Search
CPC ..... E04C 5/122; E04C 5/12; E04C 5/125; E04C 5/127; E04G 17/0721; E04G 21/121
USPC ..... 52/223.13, 698, 699, 700, 701, 702, 52/703, 704, 705, 706, 707, 708, 709, 710, 52/711, 712, 713, 714, 715
See application file for complete search history.

(56) References Cited

U.S. PATENT DOCUMENTS 3,590,474 A * 7/1971 Beghi ..... 29/452
3,762,027 A * 10/1973 Burtelson ..... 29/452
3,910,546 A * 10/1975 Connors ..... 249/40
3,965,542 A * 6/1976 Gregory ..... 24/136 R
3,965,543 A * 6/1976 Connors ..... 24/136 R
4,114,242 A * 9/1978 Luthi ..... 24/115 R
4,343,122 A * 8/1982 Wlodkowski et al. ..... 52/223.13
4,362,421 A * 12/1982 Kelly ..... 403/369
4,718,209 A * 1/1988 Hansen et al. ..... 52/223.13
4,899,499 A * 2/1990 Hoekstra ..... 52/146
4,900,193 A * 2/1990 MacKinnon ..... 405/252
5,347,777 A * 9/1994 Sudduth ..... 52/223.13
5,630,301 A * 5/1997 Sieg ..... 52/223.13
6,023,894 A * 2/2000 Sorkin ..... 52/223.8
6,240,697 B1 * 6/2001 Thompson et al. ..... 52/698
6,513,287 B1 * 2/2003 Sorkin ..... 52/223.13
6,817,148 B1 * 11/2004 Sorkin ..... 52/223.13
7,424,792 B1 * 9/2008 Sorkin ..... 52/223.13
7,765,752 B2 * 8/2010 Hayes et al. ..... 52/223.13
7,841,061 B1 * 11/2010 Sorkin ..... 29/452
8,051,615 B2 * 11/2011 Mathews et al. ..... 52/223.13
RE43,194 E * 2/2012 Toimil ..... 24/136 R
2002/0001504 A1 * 1/2002 McCallion ..... 403/374.3
2007/0175128 A1 * 8/2007 McCallion ..... 52/223.13
2008/0302035 A1 * 12/2008 Shin ..... 52/223.13
2009/0041550 A1 * 2/2009 Oldsen et al. ..... 405/259.3
2014/0223854 A1 * 8/2014 Gilling et al. ..... 52/745.21

* cited by examiner

*Primary Examiner* — Elizabeth A Plummer
*Assistant Examiner* — Kyle Walraed-Sullivan
(74) *Attorney, Agent, or Firm* — Morland C. Fischer

(57) ABSTRACT

An anchorage device and a method for connecting the device to an upstanding end of a rebar after the opposite end has been embedded in concrete. The anchorage device forms a head around the upstanding end of the rebar that will be covered with concrete to create bearing surfaces to hold the rebar in place within the concrete. The anchorage device includes a barrel having a tapered bore within which to receive the upstanding end of the rebar. A lid extends across the top of the barrel, and a threaded bolt is rotated through a threaded hole in the lid and into contact with the upstanding end of the rebar to apply an axial pushing force thereto. A segmented jaw slides through the tapered bore of the barrel into surrounding locking engagement with the upstanding end of the rebar to connect the device thereto.

15 Claims, 3 Drawing Sheets

REBAR ANCHORAGE DEVICE AND METHOD FOR CONNECTING SAME TO A REBAR

BACKGROUND OF THE INVENTION

1. Field of the Invention

This invention relates to a mechanical anchorage device and to a method for connecting the device out in the field to the upstanding end of a rebar which may be embedded within and project from a section of concrete. The anchorage device forms a wide head on the rebar which will be covered with concrete to create one or more bearing surfaces and thereby enable the rebar to better withstand forces applied thereto through the concrete.

2. Background Art

Steel reinforcement bars (i.e., rebars) are well known to be embedded within a reinforced concrete structure (e.g., a wall, panel, or the like) so that the structure will be less likely to shift or suffer damage caused by physical forces, such as those generated during an earthquake. In some cases, the rebars can become prematurely separated from their concrete structure as a consequence of tensile loads applied to the rebar.

In order to stabilize and better hold the rebars in place within the concrete structure so as to more reliably withstand tensile loads, a relatively wide head is often formed to establish a wide bearing surface at the end of each rebar. The headed end is then covered over with additional concrete. However, it is sometimes difficult to form a wide head out in the field on a rebar that is already installed and embedded in a concrete structure with one end projecting from the structure to be subjected to a heading process. While it may be simpler to head the rebar prior to its installation in the field, the precise length of the rebar that will project from the concrete structure is often difficult to predict. That is to say, the end of the rebar may need to be cut and shortened in the field resulting in the preformed head being cut off the end. In other cases, the end of each rebar is bent over to form a hook so as to increase the bearing area thereof. Alternatively, a plate has been welded to the end of the rebar. In any case, special equipment and/or tools may have to be transported into the field for post-installation treatment of the top ends of the rebars to better resist tensile loads. The requirement for special equipment and tools slows the construction project and increases cost.

Accordingly, it would be desirable to be able to quickly and reliably connect a mechanical anchor to and increase the bearing surface at the upstanding end of a rebar that projects from a concrete structure out in the field without the cost or inconvenience of having to use such special equipment and tools and without stressing or loading the rebar during the connection of the anchor.

SUMMARY OF THE INVENTION

In general terms, this invention relates to a mechanical anchor and to a method for connecting the anchor to the upstanding end of a steel reinforcement bar (i.e., a rebar) that projects from a concrete structure. Once it is connected, the rebar anchor will be embedded within concrete so as to create a large bearing surface by which to enable the rebar to better withstand tensile forces such as those which are generated during an earthquake and applied to the rebar through the concrete.

According to a preferred embodiment, the rebar anchor includes a cylindrical barrel to surround the upstanding end of the rebar. A tapered bore runs longitudinally through the barrel within which to receive the end of the rebar. A disk-shaped resistance lid extends across the top of the barrel over the end of the rebar. The diameter of the lid may be greater than the diameter of the barrel to create a bearing surface below the lid. Located inside the tapered bore through the barrel is a tapered segmented jaw that is split into a plurality of wedges. The angle of the wedges matches the angle of the tapered bore. The wedges of the jaw are laid end-to-end and seated against the tapered bore. The wedges of the jaw are configured to surround and grip the rebar. To this end, the wedges are provided with teeth or sharp threads adapted to bite into and prevent a displacement of the rebar relative to the barrel of the rebar anchor. A helically-wound spring is positioned at the top of the tapered bore of the barrel to lie between the lid and the relatively wide top end of the tapered segmented jaw of the rebar anchor.

As an important feature, a threaded bolt is moved through a correspondingly threaded bolt hole formed in the lid so as to apply an axial pushing force against the end of the rebar surrounded by the barrel. Accordingly, the rebar is pushed downwardly through the tapered bore and outwardly relative to the barrel to cause the segmented jaw to slide therealong so that the correspondingly angled wedges of the jaw close tightly around and are locked against the rebar, regardless of the diameter of the rebar. Thus, the rebar anchor is quickly and positively connected in surrounding engagement with the rebar out in the field to create a wide head thereon without requiring the use of special tools or machinery. When the rebar anchor is covered with concrete, the bottom of the cylindrical barrel creates an additional bearing surface by which to hold the rebar in place embedded in the concrete so as to be advantageously adapted to withstand tensile loads applied thereto. However, the rebar anchor of this invention does not add tension to or load the rebar to which it is connected.

DESCRIPTION OF THE PREFERRED EMBODIMENT

Figure 1:
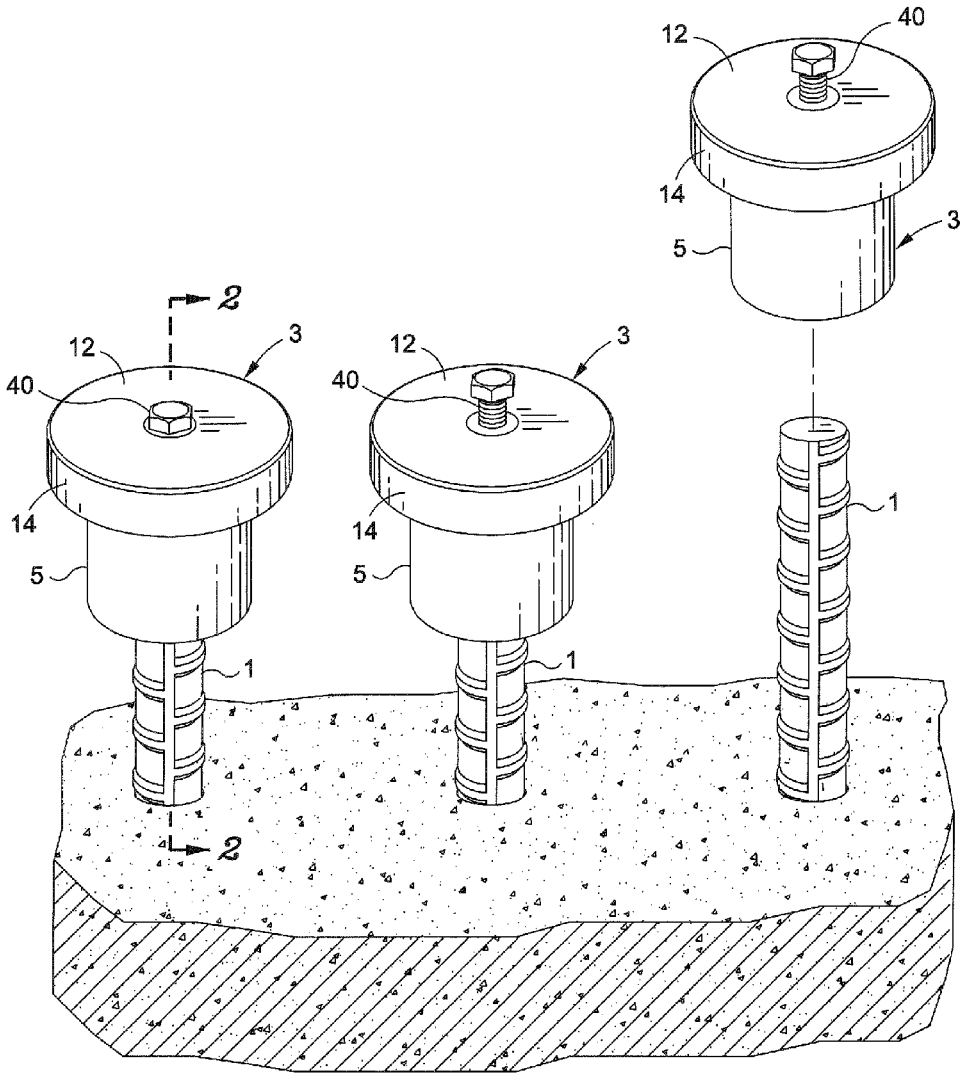
FIG. 1 shows a plurality of rebars installed within and projecting from a concrete structure so that mechanical anchors can be affixed to the upstanding top ends thereof in accordance with a preferred embodiment of this invention.

FIG. 1 of the drawings shows a plurality of conventional rebars 1 (i.e., steel reinforcement bars) protruding from a concrete structure. The rebars 1 are particularly useful to reinforce the concrete structure so as to be able to withstand physical forces such as those generated by an earthquake. Any number of rebars 1 may be embedded within the concrete structure. FIG. 1 also shows a corresponding plurality of mechanical anchors 3 attached to upstanding ends of the embedded rebars 1. The rebar anchors 3 can be advantageously installed in the field, without requiring special tools or equipment, and without tensioning the rebars 1 to which the anchors 3 are attached. That is, the rebar anchors 3 are adapted to be connected after the rebars 1 are already installed and embedded in concrete and without requiring that the upstanding ends thereof first be prepared (i.e., headed or bent). Once the post-installed rebar anchors 3 are attached to the upstanding ends of the rebars 1, the anchors and rebars are covered by and embedded within additional concrete.

Figure 2:
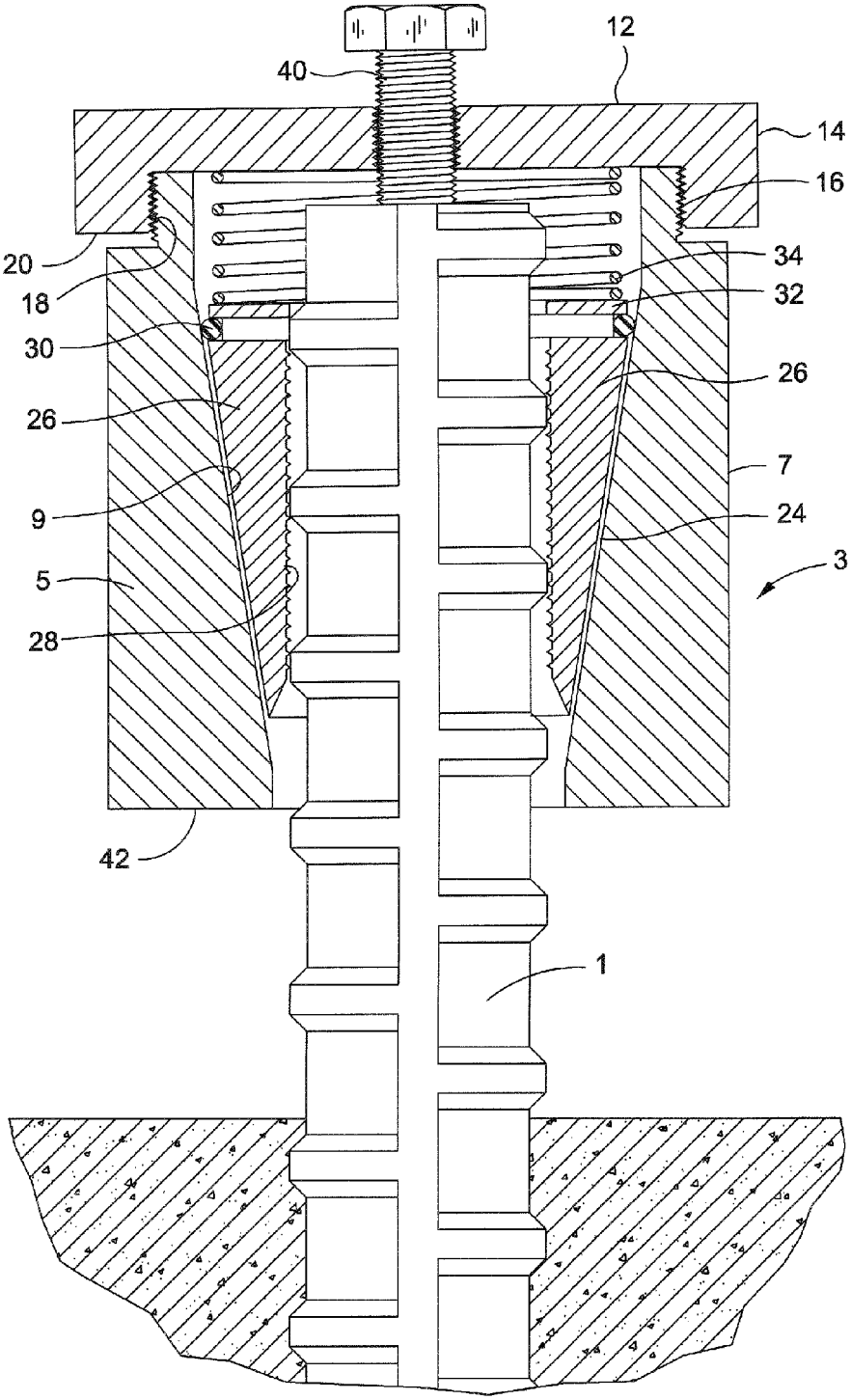
FIG. 2 is a cross-section of one of the rebar anchors taken along lines 2-2 of FIG. 1.
Figure 3:
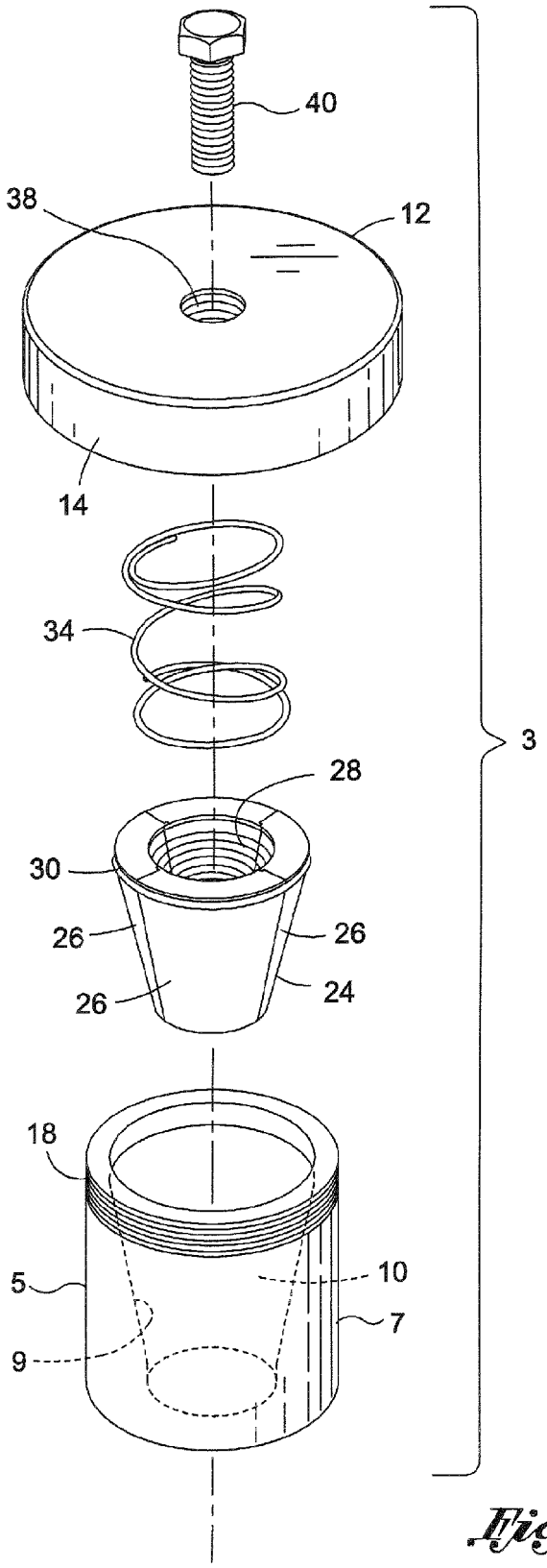
FIG. 3 is an exploded view of the rebar anchor shown in FIG. 2.

Details of the mechanical rebar anchor 3 and a preferred embodiment by which the rebar anchor is connected to a rebar are now explained while referring concurrently to FIGS. 1-3 of the drawings. A (e.g., carbon steel) barrel 5 of the rebar anchor 3 is initially pushed or hammered onto the upstanding end of the rebar 1 so that the upstanding end 1 is surrounded by barrel 5. The barrel 5 of anchor 3 has a cylindrical outside wall 7 and a tapered inside wall 9. A correspondingly tapered or angled inner bore 10 (best shown in FIG. 3) runs longitudinally through the barrel 5 for receipt therewithin of the rebar 1.

A disk-shaped resistance lid 12 is connected over the upstanding end of rebar 1. The lid 12 is preferably welded to or rotated into surrounding mating engagement across the top of the barrel 5 of rebar anchor 3 so that the upstanding end of the rebar 1 moves upwardly towards the inside of the lid 12 when the barrel 5 is attached. The lid 12 has a peripheral lip 14 extending downwardly therefrom. In the case where the lid 12 will be rotated into such surrounding mating engagement with the barrel 5, the inside edge of the lip 14 of lid 12 is provided with a set of threads 16 running therearound. The top of the barrel 5 is provided with a complementary set of threads 18 running therearound. The threaded top of barrel 5 may be recessed with respect to the cylindrical outside wall 7 thereof at which the threaded lip 14 will be received when the lid 12 is rotated around the top of barrel 5 and the sets of threads 16 and 18 are mated to one another. As best shown in FIG. 2, the diameter of the lid 12 is greater than the diameter of the barrel 5. By virtue of the recessed threads 18 of barrel 5, a secondary bearing surface 20 is created along the bottom of the lip 14 of the lid 12 after the lid 12 has been connected across the top of barrel 5.

Located within the bore 10 running through the barrel 5 of rebar anchor 3 is a tapered, segmented jaw 24. As is best shown in FIG. 3, the segmented jaw 24 is split into a plurality of independent wedges 26 that are disposed end-to-end one another and angled in order to be seated against the tapered inside wall 9 of barrel 5. A set of teeth or sharp threads 28 are formed inside the segmented jaw 24. In the assembled configuration of FIG. 1 with the rebar anchor 3 connected to the upstanding end of rebar 1, the wedges 26 of the jaw 24 are configured to surround and grip (i.e., bite into) the rebar 1 to prevent a displacement thereof relative to barrel 5 regardless of the diameter of the rebar located in the bore 10 of barrel 5.

A (e.g., steel or rubber) O-ring 30 is received by a peripheral groove formed in the wide (i.e., thickest) top ends of the wedges 26 of the jaw 24 so as to hold the wedges 26 together. Laying on top of the O-ring 30 and surrounding the rebar 1 is a disk-shaped spring support 32. A helically-wound spring 34 is located above the jaw 24 at the top of the bore 10 of the barrel 5 of rebar anchor 3. The spring 34 is sized to surround the upstanding end of rebar 1 and positioned to lie between the inside of lid 12 and the spring support 32.

As an important feature of the rebar anchor 3 disclosed herein, a threaded bolt hole 38 is formed through the lid 12. A correspondingly threaded fastener (e.g., a bolt 40) is rotated through the bolt hole 38 and into contact with the top end of the rebar 1 which is surrounded within the bore 10 of barrel 5 by the spring 34. The bolt 40 is axially advanced through the bolt hole 38 towards and into contact with the rebar 1 by means of a torque wrench or the like.

The bolt 40 applies a downward pushing force directly against the top of the rebar 1 to force the rebar downwardly through the bore 10 and slightly outward from the barrel 5 of the rebar anchor 3. The helically-wound spring 34 is compressed by the lid 12 to exert a pushing force against the spring support 32 and thereby urge the wedges 26 of the tapered and segmented jaw 24 to slide downwardly along the tapered inside wall 9 of the bore 10 of the barrel 5. As it moves through the tapered bore 10, the segmented jaw 24 will automatically close around the rebar 1. More particularly, the angled wedges 26 of jaw 24 are forced radially inward towards rebar 1 by the matching tapered bore 10 so that the teeth 28 of wedges 26 bite into and are locked against the rebar. Accordingly, the rebar anchor 3 is quickly and positively connected to the top of the rebar 1 with minimal slippage to create a relatively wide head thereon after the rebar is already installed out in the field and without requiring the use of special tools or heading machines. The axial pushing force applied by the bolt 40 takes up any slack within the barrel 5 and thereby enables the rebar anchor 3 to be snugly held in surrounding engagement with the top of rebar 1. In other words, the combination bolt 40 and resistance lid 12 cooperate to eliminate internal movement (i.e., slippage) in both tension and compression to enable the post-installed anchor 3 to replicate a pre-installed rebar having an integral head that is formed by forging or welding.

Once the rebar anchor 3 is connected to the rebar 1 to form a head at the upstanding end thereof, the anchor is covered by concrete. The relatively wide bottom of the barrel 5 of anchor 3 creates a primary bearing surface (designated 42 in FIG. 2) that will be embedded within the concrete. Moreover, in the event that the peripheral lip 14 of the lid 12 is not flush with the top of the barrel 5 in the manner shown in FIG. 2, the aforementioned secondary bearing surface 20 is also created below the lip 14 and around the barrel 5. By virtue of the mechanical rebar anchor 3 and the primary bearing surface created thereby, the rebar 1 will be reliably held in place because the forces applied to the rebar will be transferred into multi-axial stresses in the concrete below the anchor. What is more, and unlike conventional tendon and wire anchorages that are surrounded and gripped by wedges inside a barrel, the rebar anchor 3 of this invention does not require the rebar to be stressed or tensioned to ensure a tight connection thereto. In addition, the rebar anchor 3 is capable of functioning under compressive and cyclic tension-compression loading.

The invention claimed is:

1. A method for connecting an anchorage device to a steel rebar having first and opposite ends and being subject to tension and compression loads, said anchorage device including a barrel having a top, a bottom and a tapered bore running longitudinally between the top and the bottom of said barrel, a lid connected to and extending across the top of said barrel, said lid having a threaded opening formed therein, and a tapered jaw located within and slidable through the tapered bore of said barrel, said method comprising the steps of:

surrounding the first end of the rebar with said barrel of said anchorage device such that the rebar is received within the tapered jaw located within said barrel, and the lid of said barrel lies adjacent and covers the first end of the rebar;

locating a threaded fastener through the threaded opening in the lid connected to the top of said barrel and into axial alignment with the first end of the rebar within the tapered jaw that is located within the tapered bore of said barrel; and applying a force to the threaded fastener for advancing the threaded fastener towards and into end-to-end contact with the first end of the rebar for applying an axial pushing force directly against said first end and thereby causing the rebar to move through the tapered bore of said barrel and said tapered jaw to slide through said tapered bore and into locking engagement with the first end of the rebar by which said anchorage device is connected to the rebar; and covering the barrel of said anchorage device with concrete such that said barrel forms a bearing surface on the rebar for holding the rebar in place within the concrete.

2. The method recited in claim 1, wherein said fastener is a threaded bolt.

3. The method recited in claim 1, comprising the additional step of embedding the opposite end of the rebar in concrete prior to the step of surrounding the first end of the rebar with the barrel of said anchorage device.

4. The method recited in claim 1, wherein the lid of said anchorage device has a first set of threads and the top of the barrel of said anchorage device is surrounded by a second set of threads, said method comprising the additional step of rotating the first set of threads of said lid into mating engagement with the second set of threads surrounding said barrel for connecting said lid across the top of said barrel.

5. The method recited in claim 1, wherein the barrel of said anchorage device has a cylindrical shape and the lid of said anchorage device attached across the top of said barrel has a disk shape, said lid having a longer diameter than the diameter of said barrel, such that the bearing surface formed on the rebar is established underneath said lid.

6. The method recited in claim 1, wherein said tapered jaw that is located within the tapered bore through said barrel comprises a plurality of wedges lying end-to-end one another and each of said wedges having a set of teeth, said tapered jaw sliding through said tapered bore for causing the plurality of wedges of said tapered jaw to close against the first end of the rebar and the teeth of said wedges to bite into the rebar, whereby said anchorage device is connected to the first end of the rebar in response to the step of advancing the threaded fastener towards and into said end-to-end contact with the first end of the rebar for applying an axial pushing force thereto.

7. The method recited in claim 6, wherein said anchorage device also includes a spring, said method comprising the additional step of locating said spring within the tapered bore through said barrel atop said tapered jaw, such that said spring urges said tapered jaw to slide through said tapered bore and the plurality of wedges of said tapered jaw to close against the first end of the rebar, whereby the teeth of said wedges bite into the rebar to connect said anchorage device to the first end of the rebar.

8. A combination, comprising:

a steel rebar having first and opposite ends, the first end of said rebar to be embedded in concrete; and an anchorage device to be connected to the first end of said rebar prior to said first end being embedded within the concrete and without tensioning the rebar, said anchorage device including:

a barrel having an open top, an open bottom and a tapered bore running between the top and the bottom thereof in which to receive the first end of said rebar so that said barrel surrounds said rebar;

a tapered jaw located within and slidable through the tapered bore through said barrel such that said tapered jaw surrounds the first end of said rebar within said bore;

a lid connected across the open top of said barrel so as to lay adjacent and cover the first end of the rebar, said lid having a threaded opening formed therein; and a threaded fastener responsive to a rotational force applied thereto so as to move through the threaded opening in said lid connected across the open top of said barrel and into end-to-end contact with the first end of said rebar to apply an axial pushing force to said first end to cause the rebar to move axially through the tapered bore of said barrel and thereby cause said tapered jaw to slide through said tapered bore and into locking engagement with the first end of the rebar by which said anchorage device is connected to said first end to form a bearing surface to hold said rebar in place after said first end and said anchorage device connected thereto are embedded within concrete.

9. The combination recited in claim 8, wherein said threaded fastener is a threaded bolt, said threaded bolt being rotated through said threaded opening in said lid and moved into said end-to-end contact with the first end of said rebar to apply said axial pushing force thereto.

10. The combination recited in claim 8, wherein said lid has a first set of threads and said barrel is surrounded by a second set of threads, the first set of threads of said lid being rotated into mating engagement with the second set of threads surrounding said barrel for connecting said lid to the top of said barrel to cover the first end of said rebar.

11. The combination recited in claim 8, wherein said barrel has a cylindrical shape and the lid connected across the open top of said barrel has a disk shape, said lid having a longer diameter than the diameter of said barrel, such that said bearing surface is created around the first end of said rebar underneath said lid after said first end and said anchorage device connected thereto are embedded within the concrete.

12. The combination recited in claim 8, wherein the tapered jaw that is located within the tapered bore through said barrel comprises a plurality of wedges lying end-to-end one another with each of said wedges having a set of teeth, said tapered jaw sliding through said tapered bore for causing the plurality of wedges of said tapered jaw to close against the first end of the rebar and the teeth of said wedges to bite into the rebar, whereby said anchorage device is connected to the first end of the rebar in response to the axial pushing force applied by said threaded fastener to said first end.

13. The combination recited in claim 12, wherein said anchorage device also includes a spring located within the tapered bore through said barrel, said spring urging said tapered jaw to slide through said tapered bore and the plurality of wedges of said tapered jaw to close against the first end of the rebar, whereby the teeth of said wedges bite into the rebar to connect said anchorage device to the first end.

14. The combination recited in claim 13, wherein the opposite end of said rebar is embedded in concrete prior to the first end of said rebar being embedded in concrete.

15. A combination, comprising:

a steel rebar having first and opposite ends, the first end of said rebar to be embedded in concrete; and an anchorage device to be connected to the first end of said rebar prior to said first end being embedded within the concrete, said anchorage device to be embedded in the concrete with said first end, said anchorage device including:

a barrel having an open top, a bottom and a tapered bore running between the top and the bottom thereof in which to receive the first end of said rebar;

a tapered jaw located within and slidable through the tapered bore of said barrel to surround the first end of the rebar received within said bore;

a lid having a threaded opening formed therein and extending completely across the open top of said barrel so as to lie adjacent and cover the first end of the rebar received within the tapered bore of said barrel;

a spring located within the tapered bore of said barrel and lying between said lid and said tapered jaw so as to urge said tapered jaw to slide through said tapered bore; and a threaded pushing member responsive to a rotational force applied thereto for moving through the threaded opening formed in said lid for applying a pushing force against the first end of the rebar such that the rebar moves axially through said tapered bore towards the bottom of said barrel and said tapered jaw slides through said tapered bore and into locking engagement with the first end of the rebar by which said anchorage device is connected to said first end to form a bearing surface to hold said rebar in place after said first end and said anchorage device connected thereto are embedded within the concrete.

* * * * *